US005803707A

United States Patent [19]

Schips et al.

[11] Patent Number: 5,803,707

[45] Date of Patent: Sep. 8, 1998

[54] SLIDE-IN CROSS CURRENT VENTILATOR

[75] Inventors: Karl Schips, Urbach; Rolf Fichter, Fellbach, both of Germany

[73] Assignee: LTG Lufttechnische Gesellschaft mit beschrankter Haftung, Stuttgart, Germany

[21] Appl. No.: 297,997

[22] Filed: Aug. 30, 1994

[30] Foreign Application Priority Data

Aug. 30, 1993 [DE] Germany ..... 43 28 945.2

[51] Int. Cl.[6] ..... F04D 5/00

[52] U.S. Cl. ..... 415/53.1; 415/213.1

[58] Field of Search ..... 415/53.1, 177, 415/214.1, 213.1, 170.1

[56] References Cited

U.S. PATENT DOCUMENTS

| | | | |
|---|---|---|---|
| 3,250,457 | 5/1966 | Walker | 415/53.1 |
| 3,263,749 | 8/1966 | Dormitzer | 415/53.1 |
| 3,279,209 | 10/1966 | Laing | 415/43.1 |
| 3,857,189 | 12/1974 | Katayana et al. | 415/53.1 |
| 5,085,057 | 2/1992 | Thompson et al. | 415/177 |

*Primary Examiner*—John T Kwon

*Attorney, Agent, or Firm*—Anderson, Kill & Olick, P.C.

[57] ABSTRACT

A slide-in cross current ventilator including a drive for driving the ventilator impeller which is connected to the drive device in a cantilever manner, an air guide shrouding associated with the impeller, and a flange for mounting the slide-in ventilator at an installation site and located between the drive and the impeller.

14 Claims, 14 Drawing Sheets

Fig. 15
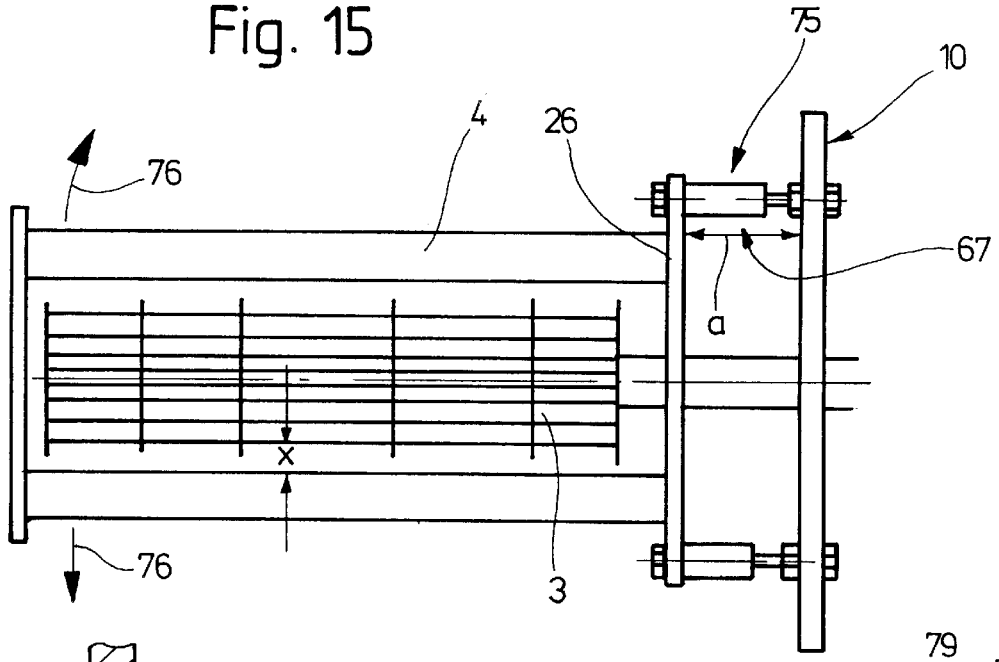
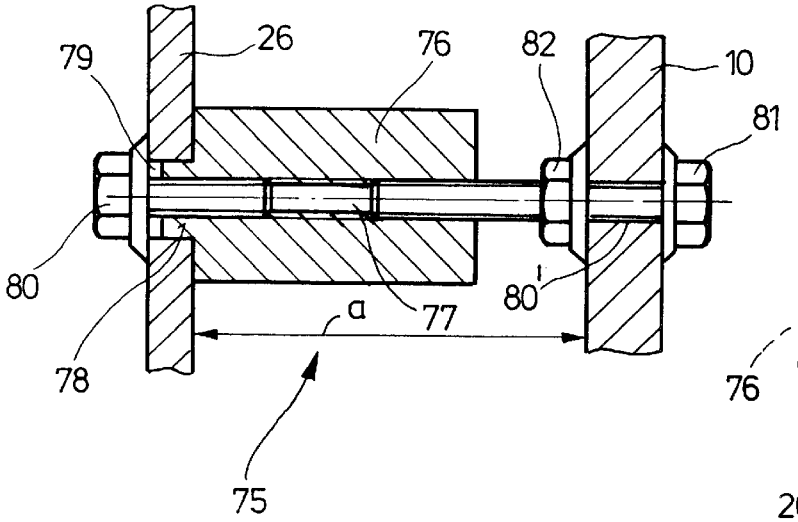
Fig. 16
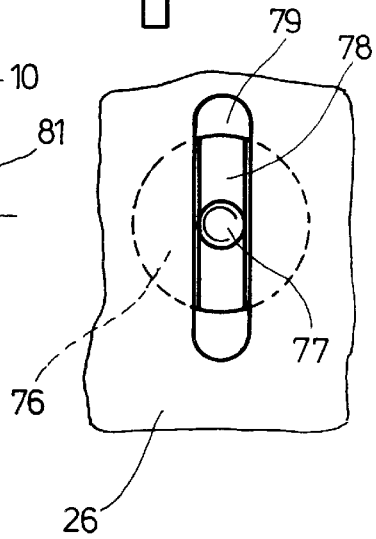
Fig. 17

SLIDE-IN CROSS CURRENT VENTILATOR

BACKGROUND OF THE INVENTION

The present invention relates to a cross current ventilator including an impeller, a drive for driving the impeller, and an air guide shrouding associated with the impeller.

Numerous types of cross current ventilators of the above-described type are presently available. When a cross current ventilator is designed as a unitary structural component for some kind of apparatus, e.g., for hot gas furnaces, the ventilator includes a housing with which an air guide shrouding, which cooperates with an impeller, is associated. The impeller is located inside the housing, and a drive which, preferably, comprises an electromotor, is attached to an end wall of the ventilator housing.

The housing is provided with an attachment arrangement, e.g., with a perforated sheet footing, for mounting the ventilator at the installation site. Such cross current ventilator units are provided with an impeller supported at opposite sides.

An object of the invention is a cross current ventilator which, as a unit, can be used with another apparatus or installation and can be easily attached to the housing of the apparatus or installation.

Another object of the invention is a cross current ventilator which can be easily produced, easily mounted at an installation site, and easily replaced.

A further object of the invention is a cross current ventilator with an optimal sealing between the region of the ventilator drive and the front, air handling portion of the ventilator.

SUMMARY OF THE INVENTION

These and other objects of the invention, which will become apparent hereinafter, are achieved by providing a cross current ventilator having an impeller, which is supported in a cantilever manner, and a mounting flange arranged in the region between the impeller and the impeller drive. Using a mounting flange, together with forming the ventilator as a slide-in unit, facilitates manufacture of the ventilator and insures easy mounting and maintenance.

The mounting flange, which is located between the impeller and the drive, represent a quasi-integral component of the ventilator and, thus, does not represent an auxiliary part which serves only for mounting of the ventilator, but also serves as a support for elements of the ventilator. As a result, operational forces or loads are transmitted directly to the mounting flange.

During the installation or exchange of the ventilator, the ventilator unit is pushed into position until the mounting flange is in a position in which the ventilator is secured at the installation site. At the installation site, the mounting flange is secured to an appropriate part, with or without sealing means as the case may be, with appropriate attachment means. When the ventilator needs to be removed, the attachment means are released and the unit, together with the mounting flange, is axially pulled out from its location.

Forming the ventilator as a slide-in unit permits its use in previously inaccessible locations, and its mounting in such locations does not require any expensive dismantling of the unit elements and can be effected without use of additional fixtures.

The mounting plate also provides for easy sealing of the front portion of the ventilator from the surrounding atmosphere. As a result, the inner atmosphere of the apparatus, or the installation with which the ventilator is used, is not influenced by the surrounding atmosphere. Using the mounting flange also provides for reliable heat insulation between the front, operational, and drive portions of the ventilator. Due to the cantilever arrangement of the impeller, it is supported only at one side. That is, only the side of the impeller which is adjacent to the drive is supported.

According to an embodiment of the ventilator of the present invention, the mounting flange is formed as a mounting plate. Preferably, a metal plate is used. The mounting plate can be formed as a rectangular or circular plate. In case a rectangular plate is used, mounting openings are formed in the four angles of the plate, with the angular region extending beyond the periphery of the ventilator itself. This facilitates attachment of the ventilator at the installation site because the other elements of the ventilator do not interfere with its attachment.

The outer region of the mounting flange forms a stop surface and, if needed, a sealing surface. The mounting flange, especially when formed as a mounting plate, extends transversely, preferably perpendicular, to the longitudinal extent of the impeller shaft or to the shaft of the drive. As it has already been mentioned previously, the mounting flange can also be circular, especially when a reliable sealing is required. The attachment of the mounting flange can be effected with a bayonet lock or threading connection.

When a gas-proof embodiment of the ventilator is required, the mounting flange can be formed as a precise part serving as a leak-free seal between the front portion of the ventilator and the surrounding atmosphere.

Advantageously, the air guide shrouding can be attached to the mounting flange. According to the invention, the air guide shrouding is attached to the mounting flange in a cantilever manner. Thus, the mounting flange serves not only for attaching the ventilator at the installation site, but also forms a carrier for the air guide shrouding, which is necessary for producing a radial air flow through the impeller. However, it should be pointed out that the air guide shrouding can be formed as an integral part of the installation site.

In another embodiment of a cross current ventilator according to the present invention, the drive can also be secured to the mounting flange. The drive, as the air guide shrouding, can be secured in a cantilever manner.

When both the air guide shrouding and the drive are secured to the mounting plate, they are secured to opposite sides of the mounting plate in a cantilever manner. In this case, a very simple and rational structure of the ventilator is obtained.

Advantageously, the drive comprises an electromotor. However, the impeller can be driven by a belt or chain drive, with a belt pulley or the sprocket wheel mounted on the impeller shaft. In this case, a separate motor need be used.

It is advantageous when the drive includes two axially spaced bearings which simultaneously provide for support of the impeller. When the drive comprises an electromotor, its rotor is supported by two bearings at spaced locations, and the bearings also serve for supporting the impeller. Thus, the impeller is connected to the motor in a cantilever manner.

Advantageously, when an electromotor, the rotor of which is supported at two locations, is used, it is provided with an elongate stub shaft, the length of which is so selected that the elongate stub shaft of the electromotor also serves as a shaft of the impeller. In this case, means connecting the impeller shaft with the electromotor shaft is eliminated.

According to a further embodiment of the invention, the mounting flange is provided with a slide tubular bearing. In this embodiment, the impeller is supported on the mounting flange with another support being formed by the drive.

In the cross current ventilator according to the invention used for conveying a hot or cold gas stream, a radial barrier wall is provided between the mounting flange and the adjacent end side of the impeller, with the space between the barrier wall and the mounting flange defining a heat or cold insulation zone. In this zone, stationary air or gas cushions are formed which prevent the heat or cold, as the case may be, from reaching the drive bearings.

The radially extending barrier wall shields the bearings and/or the drive from the utilized air stream which flows in the front portion of the ventilator. The mounting flange also forms a kind of a barrier wall, and the air or gas cushion, formed between the barrier walls, prevents any damage which otherwise might have been caused by high or low temperatures.

According to a still further embodiment, a plurality of additional axially spaced barrier walls is provided in the insulation zone. The term "axial" is used with reference to the axis of the impeller shaft or the drive shaft. Respective air or gas cushions are formed between the barrier wall and an adjacent additional barrier wall, and between the additional barrier walls themselves. The barrier wall(s) can be attached to the flange and/or the air guide shrouding. In this case, stationary barrier walls are obtained. The stationary barrier walls are alternated with barrier walls mounted on the impeller for joint rotation therewith.

According to yet a further embodiment of the invention, the stationary and the rotatable barrier walls can form labyrinth seals.

According to yet another embodiment of the invention, the impeller has an extension portion on opposite sides of the portion thereof, in which the utilized air stream flows. That is, the impeller extends beyond the utilization portion thereof, in the axial direction. The extension portion of the impeller projects into the insulation zone between the barrier wall and the mounting flange.

It is also possible to form the air guide shrouding and/or the barrier walls, with air or gas cushions between the barrier walls, as an integral part of the installation site. In this case, the ventilator would consist of two separate portions (i) a structural component, including the air guide shrouding with the structural component being a stationary part of the installation site; and (ii) a slide-in portion without the air guide shrouding.

The slide-in portion would then include a mounting flange or plate with sealing elements and with an impeller, projecting from one side of the mounting flange, and the drive being attached to the other side of the mounting flange.

The extension portion of an impeller can be provided with its own radial barrier wall. A plurality of such radial barrier walls can be arranged on the extension portion of the impeller, which projects into the insulation zone. Thus, a plurality of air or gas insulation zones are formed. With the stationary barrier walls and the rotatable barrier walls being arranged in overlapping relationship, a labyrinth seal is formed.

According to still another embodiment of the invention, an admission air path is provided in a ventilator according to the present invention. Through this admission path, atmospheric air flows axially into the insulation zone and the interior of the impeller, and then flows radially out of the impeller. This air flow forms, in the region of the extension portion of the impeller, a hot or cold insulation. The impeller in this region functions not as a cross current impeller, but rather as a compressor drum.

The impeller can have a shaft projecting from the impeller end wall, with the impeller being arranged on the shaft as a cantilever cage-like structure. Alternatively, the impeller shaft can extend along the entire length of the impeller. In the latter case, support discs can be arranged on the impeller elongate shaft, which discs carry the impeller blading.

Further, additional cooling means, in the form of a cooling fan, can be provided in the region between the mounting flange and the drive.

The impeller of the cross current ventilator, according to the present invention, generally has a large diameter-to-length ratio up to 1:10, but preferably, 1:5.

BRIEF DESCRIPTION OF THE DRAWINGS

The features and objects of the present invention will become more apparent, and the invention itself will be best understood from the following detailed description of the preferred embodiments of the invention when read with reference to the accompanying drawings, wherein:

FIG. 15 is a partial side elevational view of yet further embodiment of a cross current ventilator, according to the present invention, showing an adjusting device for aligning an air guide shrouding with an impeller;

FIG. 16 is a partial cross-sectional view of an element of the adjusting device of the cross current ventilator, which is shown in FIG. 15;

FIG. 17 is an end view of a portion of the adjusting element shown in FIG. 16.

DETAILED DESCRIPTION OF THE PREFERRED EMBODIMENTS

Figure 1:
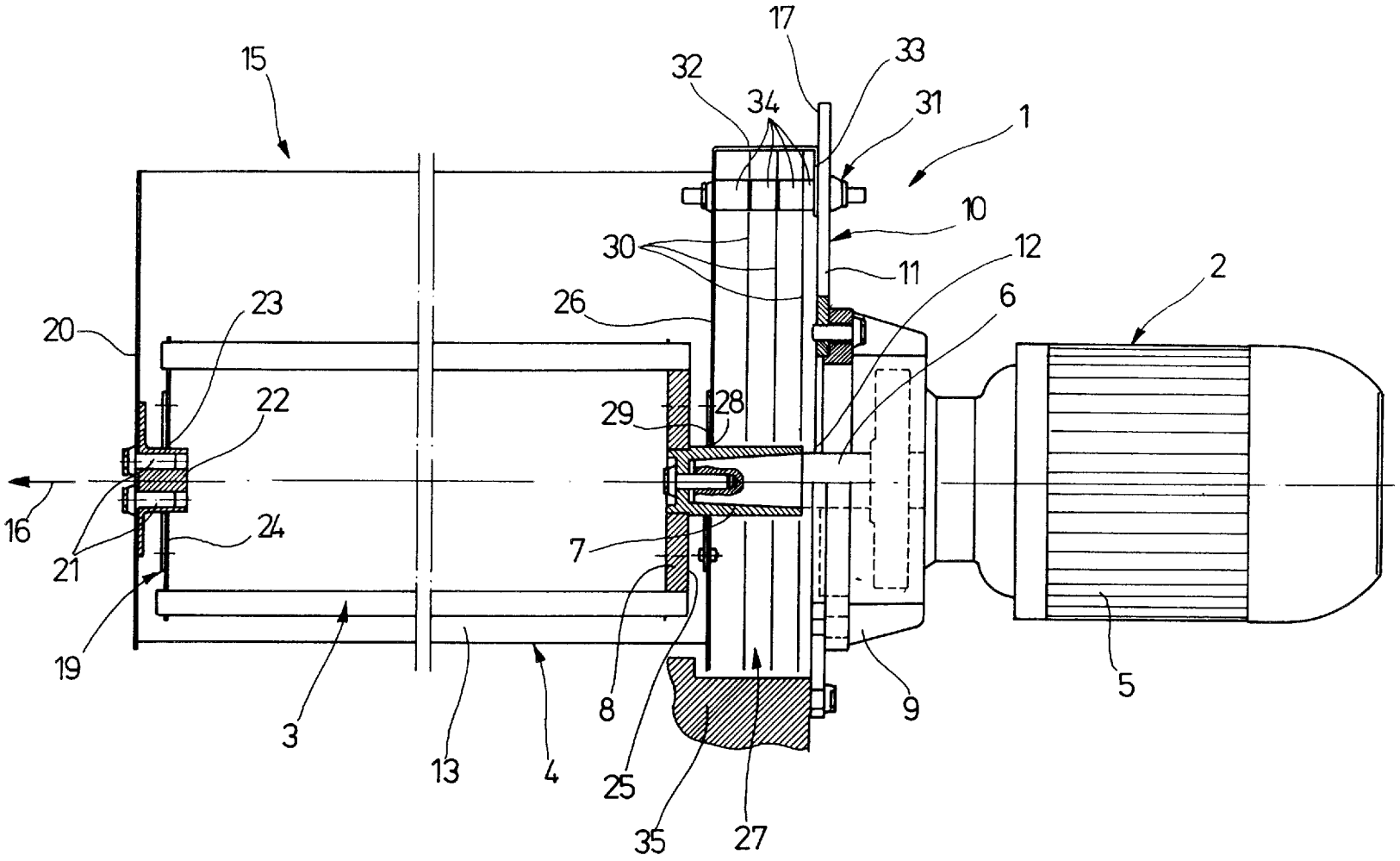
FIG. 1 is a partially cross-sectional side view of a cross current ventilator according to the present invention.

A cross current ventilator, according to the present invention, which is shown in FIG. 1, comprises a drive 2, an impeller 3 and an air guide shrouding 4. The drive 2 comprises an electromotor 5 with a stub shaft 6 which is fixedly connected to the end wall 8 of the impeller by a taper attachment 7. The impeller 3 is supported on the stub shaft 6 of the electromotor 5 in a cantilever manner. The electromotor 5 is equipped with conventional rotor bearings which, in the described structure, also serve as the impeller bearings.

The electromotor 5 is equipped with a flange 9 which is screwed to the mounting flange 10. The mounting flange 10 is formed, when viewed in the plan view, as a rectangular plate 11 the dimensions of which are so selected, with regard to the dimensions of the ventilator, that the end portions of the mounting flange 10 project beyond the parts of the ventilator 1.

The plane of the mounting plate 11 extends perpendicular to the longitudinal extent of the stub shaft 6 and to the longitudinal extent of the impeller 3. The mounting plate 11 is located, as can be seen in FIG. 1, between the drive 2 and the impeller 3. The mounting plate 11 provides for mounting of the ventilator 1 at the installation site.

Figure 2:
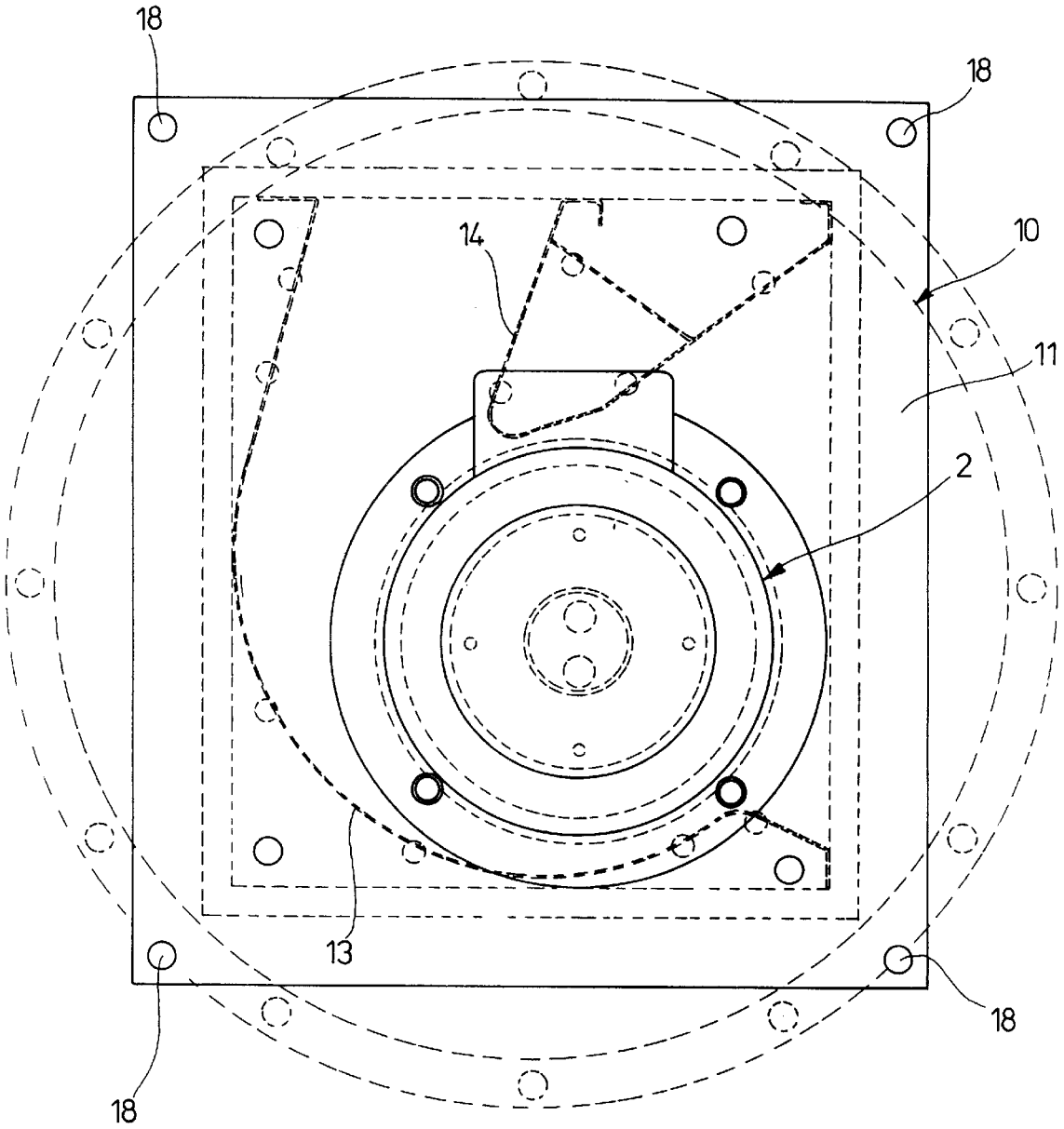
FIG. 2 is an end view of the cross current ventilator shown in FIG. 1.

As it has already been previously mentioned, the drive 2 is attached by the flange 9 thereof to one side of the mounting plate 11. The mounting plate 11 has an opening 12 through which the stub shaft 6 extends. The air guide shrouding 4 is attached to the other side of the mounting plate 11. The air guide shrouding has, as shown in FIG. 2, a guide wall 13 and a wedge profile 14. As also shown in FIG. 2, the end portions of the rectangular mounting plate 11 extend beyond the conventional periphery of the cross current ventilator 1.

The cross current ventilator 1 is formed as a slide-in unit, which is generally designated with the reference numeral 15 and which, during its mounting, is displaced in the direction of arrow 16, shown in FIG. 1, with regard to the installation site. For example, the ventilator 1 can be pushed through the opening in a carrier plate of some kind of apparatus (e.g., hot-air furnace), with the outer regions 17 of the mounting plate 11 abutting the carrier plate. The attachment of the mounting plate 11 to the carrier plate can be done by suitable connection means, e.g., with bolts extending through the holes 18 provided in the corner regions of the mounting plate 11.

The dash lines in FIG. 2 show a circular mounting plate 11 with connection openings provided along the periphery of the mounting plate. A circular mounting plate is generally used when the mounting plate also serves as a sealing which protects the front portion of the ventilator from the surrounding atmosphere. In this case, when the mounting plate serves as sealing means, it reduces heat exchange between the front portion of the ventilator and the bearings. This is a definite advantage when the front portion is surrounded with hot gases. Advantageously, however, sealing means, usually provided between the mounting plate and the edge region of the mounting opening in the installation site, increases the air-tightness of the sealing arrangement.

As shown in FIG. 1, an end wall 20 of the air guide shrouding 4 is arranged opposite the impeller 3, with a center mandrel 22 being secured to the end wall 20 with screws 21. The mandrel 22 extends into an opening 23 of an end wall 24 of the impeller 3 with a possibility of a radial play. The mandrel 22 insures reliable transportation of the ventilator. Specifically, it insures that the impeller does not substantially deviate from its position under impact loads and the like.

The mandrel 22 further insures that, during operation, the position of the impeller 3 is maintained within predetermined limits and does not run untrue. As a result, there is provided an attachment device which always provides for proper centering under any required conditions, normal, critical, and extremely or super critical operational conditions. When the impeller is very short, such attachment device is not used.

The impeller 3 can be formed as a welded structure, a rolled structure, or a joint structure. Advantageously, the impeller is formed as a "soft" (non-rigid) structure, so that it self-centers at extremely critical drive conditions. The material of the impeller is so selected that it corresponds to very low or very high temperatures of the conveyed gases. This, of course, is applied to other conventional elements of the cross current ventilator in particular, to the air guide shrouding 4.

FIG. 1 shows that a barrier wall 26 is provided between the mounting flange 10 and the end wall 25 of the impeller 3, adjacent to the end wall 25, and in a spaced relationship from the mounting plate 11. As a result, a hot or cold insulation zone 27 is provided between the mounting plate 11 and the barrier wall 26. The barrier wall 26 forms an end wall of the air guide shrouding.

The barrier wall 26 has an opening 28 through which the sleeve part of the taper attachment 7 extends. At the opening 28, a sliding seal 29 is provided for sealing the front portion of the cross current ventilator 1. The seal, if formed as a high-quality seal, is a gas-proof seal.

As shown in FIG. 1, the insulation zone 27 in the upper region of FIG. 1 is different from the insulation zone 27 in the lower FIG. 1. Thus, actually two embodiments are shown in FIG. 1. The insulation zone 27 of the upper region comprises three additional spaced barrier walls 30 which are connected to the air guide shrouding 4 by a connecting element 31. The barrier wall 26 extends to the mounting plate 11 by forming a C-shaped profile including two sections 32 and 33 forming an angle of 90°.

The connecting element 31 may comprise a threaded bolt extending through the mounting plate 11, section 33, and barrier walls 26 and 30 which are separated by spacers 34. The separating spacers 34 hold the walls 30 in their predetermined position. The nuts insure proper connection. A plurality of such connecting elements are arranged about the rotational axis of the ventilator at predetermined angular spacing from each other. This construction of the insulation zone 27 provides for formation of gas, e.g., air insulating cushions which insure heat or cold insulation between the front portion of the ventilator 1 and the drive 2. These insulation cushions also provide for proper support.

In the lower portion of FIG. 1, the insulation zone 27 is formed differently. Here, the barrier wall 26 has no C-shaped profile formed by sections extending at an angle of 90° to each other. Rather, the barrier walls 26 and 30 are held together by connecting elements (not shown) substantially similar to the connecting element 31, with the barrier wall 26 being connected to the guide wall 13. The radial sealing of the insulation zone 27 is provided by an installation site wall 35, to which the mounting flange 10 can be screwed.

Figure 3:
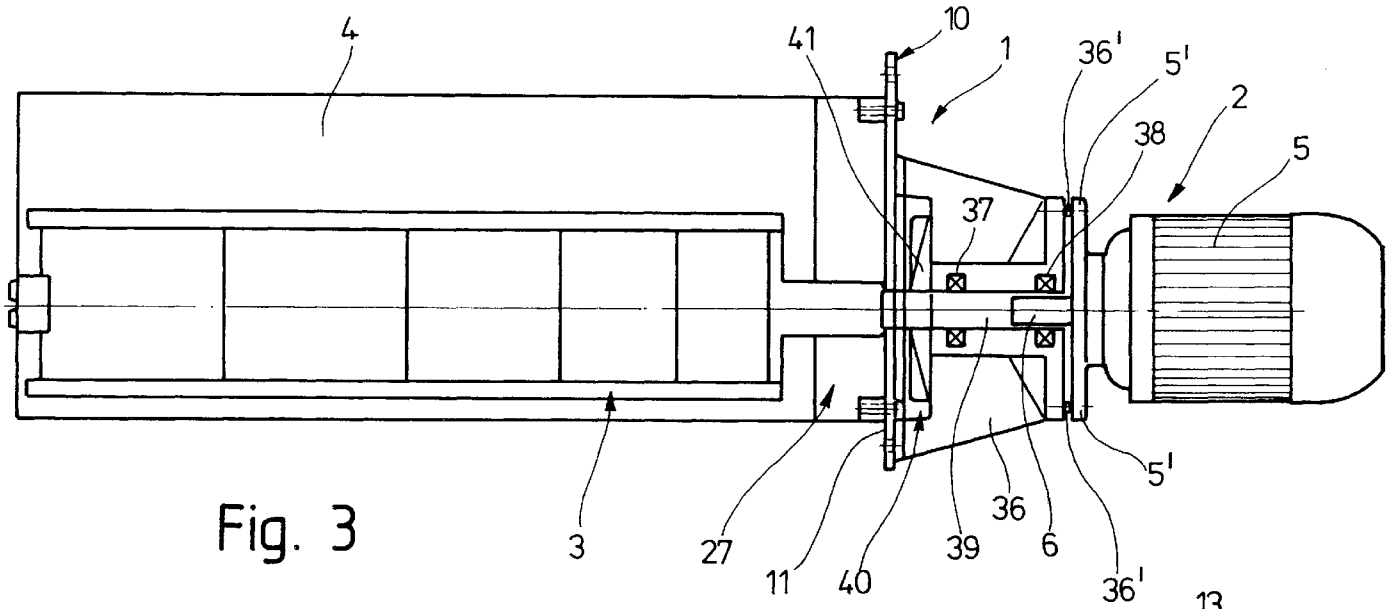
FIG. 3 is a side elevational view of another embodiment of a cross current ventilator according to the present invention.
Figure 4:
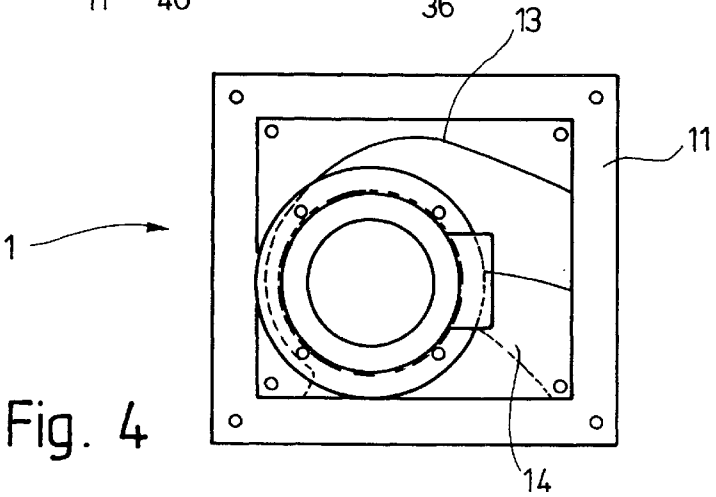
FIG. 4 is an end view of the cross current ventilator shown in FIG. 3.

The stub shaft 6 also may support a cooling device 40 for cooling the drive 2. The cooling device 40 includes a cooling fan 41. Such a cooling device is shown in FIG. 3. FIGS. 3 and 4 show another embodiment of a cross current ventilator, according to the present invention, which somewhat differs from the ventilator shown in FIGS. 1 and 2. Below, only the differences between the ventilators shown in FIGS. 1, 2 and 3, 4, respectively, will be discussed.

The electromotor 5 of the drive 2 of the ventilator 1, shown in FIGS. 3 and 4, includes an intermediate flange 36 which is supported by two bearings 36 and 37. The intermediate flange 36 includes a connecting shaft 39, which is connected at its opposite ends to the stub shaft 6 of the electromotor 5 and to the impeller 3, for joint rotation with the stub shaft 6 and the impeller 3.

The cooling device 40 is supported on the connecting shaft 39. The cooling device 40 serves for cooling of the bearings 37 and 38 and the drive 2. A resilient element $36^1$ that, for example, may be formed as a rubber bung, provides for joint rotation of the electro-motor 5 and the intermediate flange 36. The resilient element $36^1$ provides for the transmission of torque from the electromotor 5 to the intermediate flange 6 and, at the same time, permits to compensate alignment errors between the stub shaft 6 and the intermediate shaft 39.

The impeller 3 is supported on an end of the intermediate shaft 39 remote from the electromotor 5. The resilient element $36^1$ is engaged between the intermediate flange 36 and a flange $5^1$ of the electromotor 5. As shown in FIG. 3, an insulation zone 27 is provided between the impeller 3 and the mounting flange 10. The insulation zone 27, in the embodiment shown in FIGS. 3 and 4, does not include any barrier walls.

Figure 5:
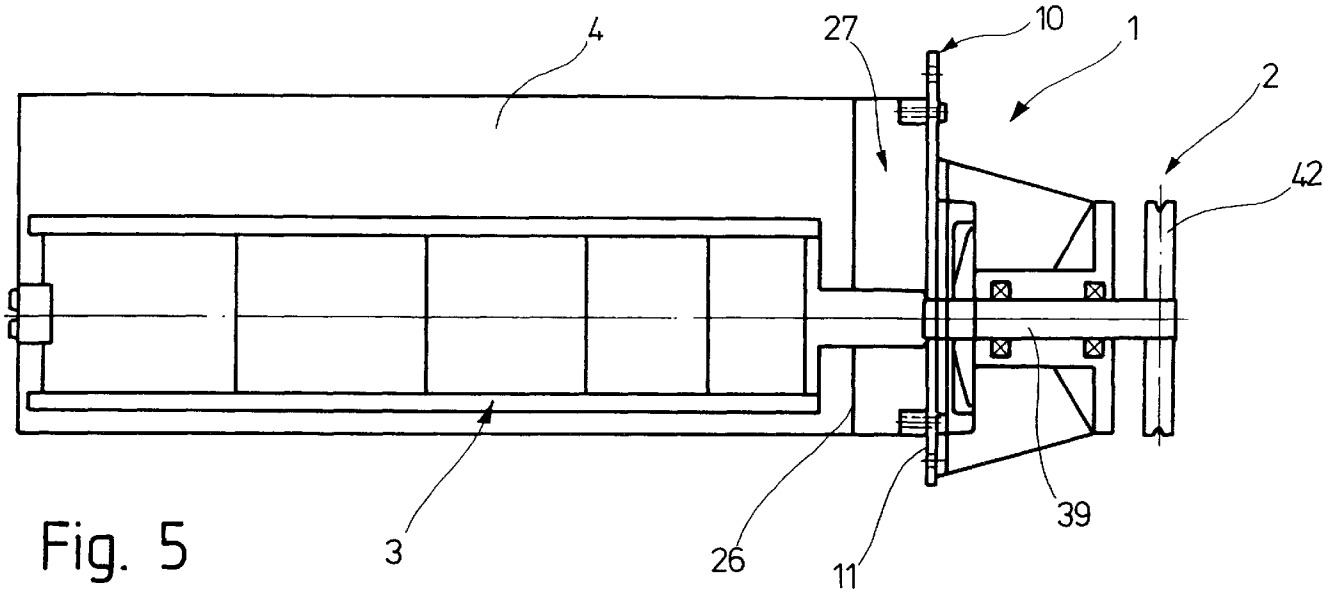
FIG. 5 is a side elevational view of yet another embodiment of a cross current ventilator according to the present invention.
Figure 6:
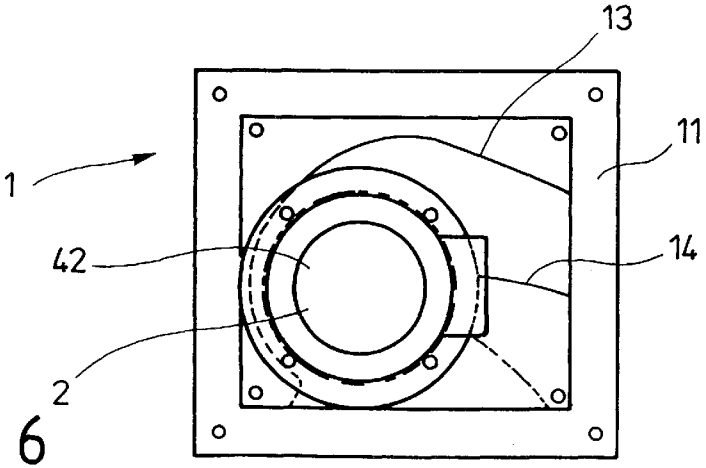
FIG. 6 is an end view of the cross current ventilator shown in FIG. 5.

FIGS. 5 and 6 show yet another embodiment of a cross current ventilator according to the present invention. The embodiment of the ventilator, shown in FIGS. 5 and 6, is substantially similar to the embodiment of the ventilator 1 shown in FIGS. 3 and 4. The embodiment shown in FIGS. 5 and 6 differs from that of FIGS. 3 and 4 in that instead of the electrical motor 5, the ventilator is driven by a belt drive, including a belt pulley 42, which is mounted on an end of the intermediate shaft 39 remote from the impeller 3.

As it should be clear, a separate drive (not shown) is used for driving the ventilator 1 of the embodiment shown in FIGS. 5 and 6. In the embodiment of the ventilator 1 shown in FIGS. 5 and 6 as well as in the other embodiments, the opening in the barrier wall 26 can be sealed with a sliding seal (not shown). A similar seal may be provided for sealing an opening in the mounting flange 10 through which the shaft 39 extends.

These seals are generally gas-proof so that the front portion of the ventilator 1 is sealed from the surrounding atmospheric air when the ventilator is mounted, by means of the mounting flange 10, to an installation or the like. The sealing may be effected with a copper disc when a sliding seal is used. The sealing in the region of the mounting flange 10 can be formed either as a rotary shaft seal or as a mechanical seal.

Figure 7:
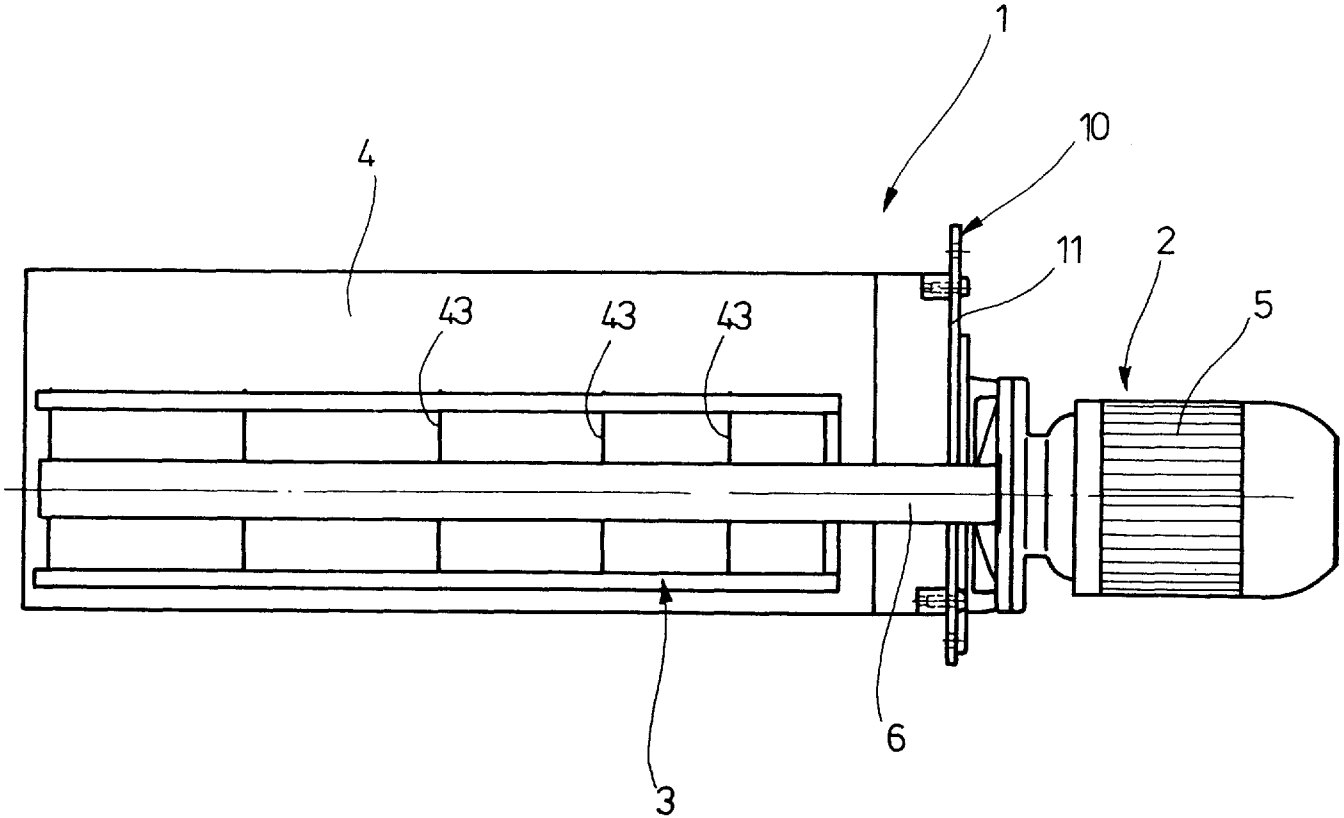
FIG. 7 is a side elevational view of a further embodiment of a cross current ventilator according to the present invention.

FIG. 7 shows a further embodiment of a cross current ventilator, according to the present invention. In the embodiment of FIG. 7, a special electromotor is used for driving the ventilator. The electromotor 5 of the ventilator of the embodiment of FIG. 6 has an elongate "stub shaft" 6, that is, a stub shaft that extends through the entire device, i.e., over the entire length of the impeller 3. In this case, the bearings of the electromotor 5 serve as bearings for the impeller 3.

The stub shaft 6 can be formed either as a solid shaft or, with regard to thermal conditions, as a hollow shaft. In the embodiment of FIG. 7, there are provided spaced support discs 43, to which an axially extending impeller blading is attached. The ventilator, shown in FIG. 7, is shown without transportation safety means. This means that the safety means can be eliminated when the impeller has a sufficient rigidity. The same applies to the previously described embodiments of the cross current ventilator according to the present invention.

Figure 8:
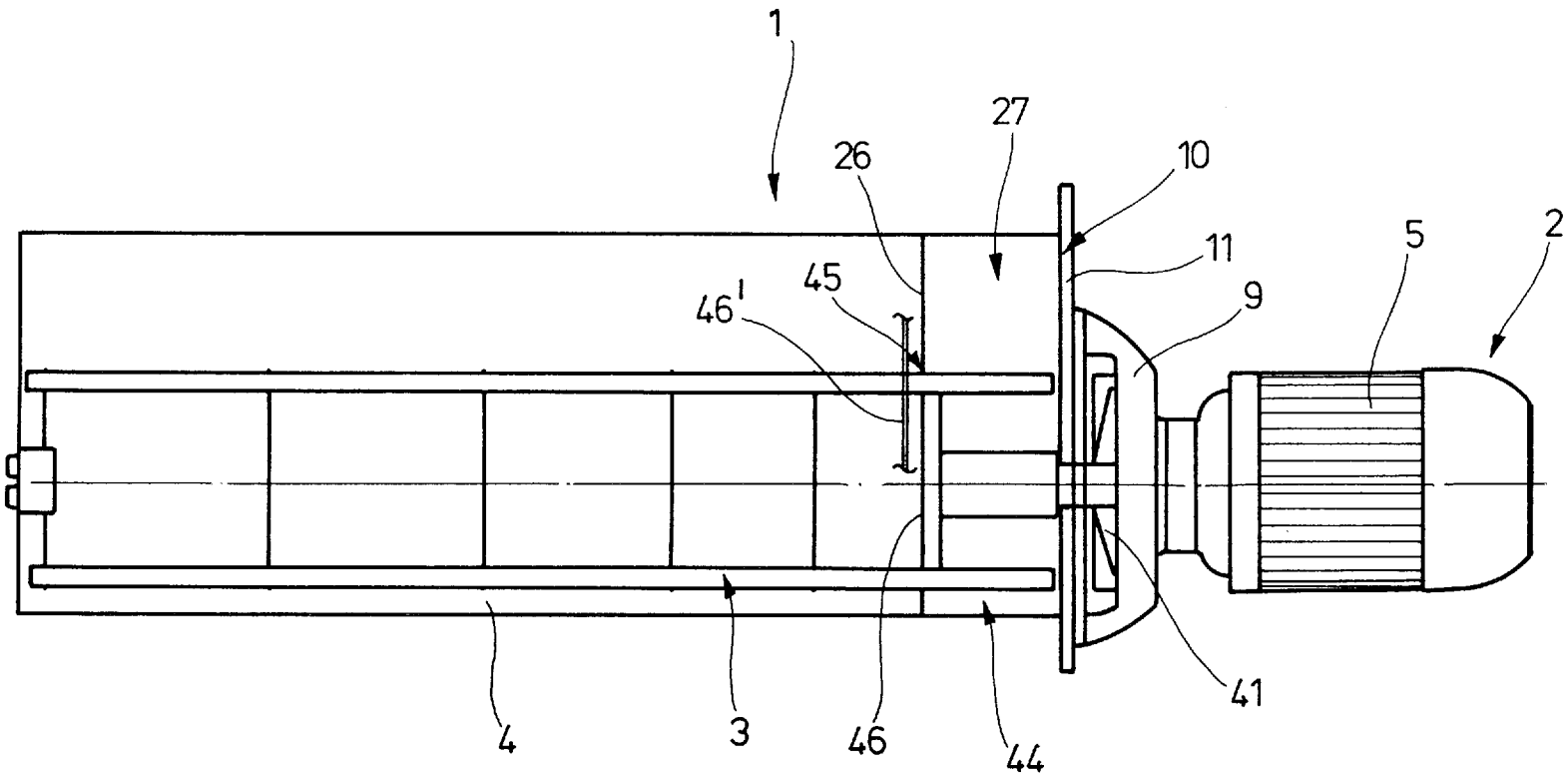
FIG. 8 is a side elevational view of a still further embodiment of a cross current ventilator according to the present invention.

FIG. 8 shows still a further embodiment of a cross current ventilator according to the present invention, which is somewhat similar to the embodiment shown in FIG. 1. The embodiment shown in FIG. 8 differs from the embodiment shown in FIG. 1 in that the impeller 3 has an extension portion 44, i.e., the impeller blading extends into the insulation zone 27. The insulation zone 27 of the embodiment of FIG. 8, in opposition to previously discussed embodiments, has no air or gas insulation cushions. Instead, a turbulence is created in the insulation zone 27 by the extension portion 44 of the impeller blading, providing for the required cooling.

The barrier wall 26 is provided with an opening 45 through which the impeller 3 projects into the insulation zone 27. The impeller 3 is provided inside thereof with a closure wall 46, which closes the insulation zone 27. The closure wall 46 is aligned with the barrier wall 26. In the embodiment of FIG. 8, the impeller 3 can be provided with a supporting disc $46^1$ which, together with the barrier wall 26, forms a labyrinth seal. The position of the supporting disc $46^1$ is shown in FIG. 8 schematically.

Figure 9:
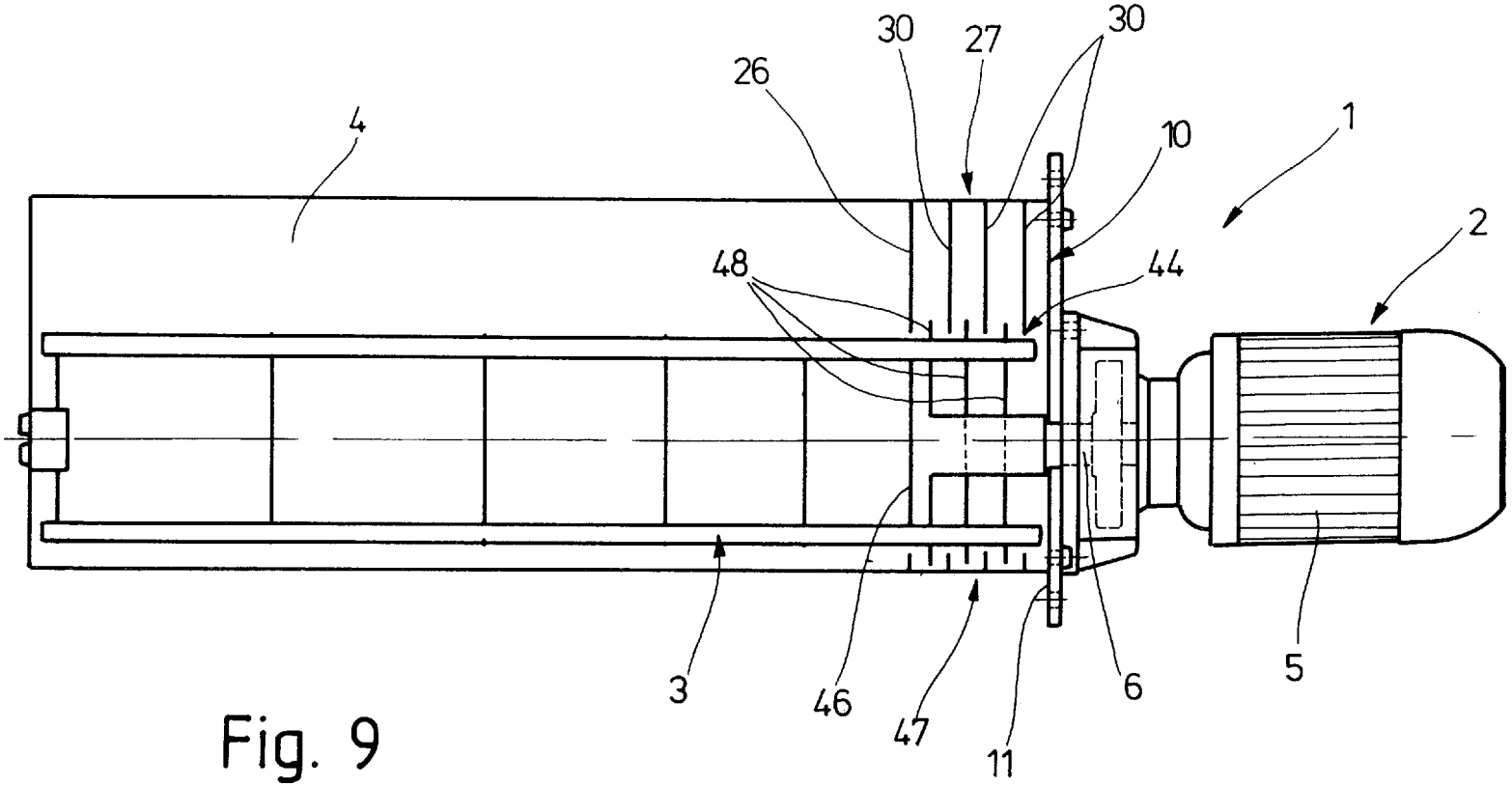
FIG. 9 is a side elevational view of yet further embodiment of a cross current ventilator according to the present invention.

The embodiment of the cross current ventilator shown in FIG. 9 is substantially similar to the embodiment of the ventilator shown in FIG. 8. In the embodiment shown in FIG. 9, the insulation zone 27, in opposition to the embodiment of FIG. 8, is divided into separate compartments by axially spaced barrier walls 30. As in the embodiment of FIG. 8, the impeller 3 of the embodiment of FIG. 9 is provided with a closure wall 46. The barrier walls 26 and 30 are provided with corresponding openings through which the impeller 3 projects into the insulation zone 27.

In addition, barrier walls 48 may be provided in the impeller 3 for being located between the barrier walls 26 and 30 to form labyrinth seals 47. As shown in FIG. 9, the stationary barrier walls 26 and 30 alternate with barrier walls 48 which rotate together with the impeller 3.

Figure 10:
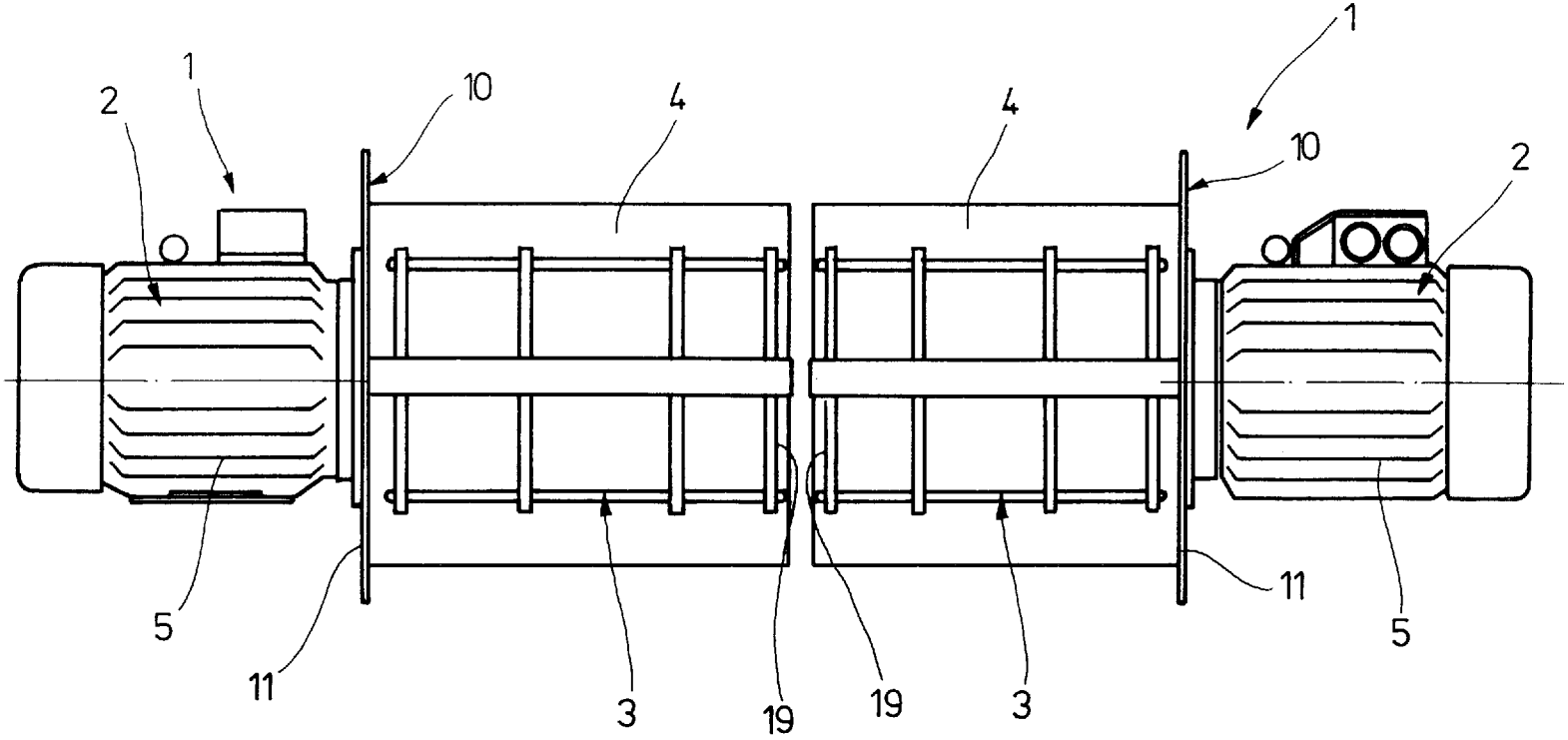
FIG. 10 is a side elevational view of two cross current ventilators, according to the present invention, arranged axially opposite each other.

FIG. 10 shows an embodiment of a cross current ventilator according to the present invention and including two impellers 3, which are arranged opposite to each other and driven by separate drives 2, with free ends 19 of the impellers 3 being arranged adjacent to each other. Such arrangement permits to use the ventilator, according to the present invention, in a location with a very wide air current zone. When the embodiment of FIG. 10 is used, the two single cross current ventilators are slided into their operational zone from opposite sides.

When a dismantling or an exchange is required, the respective mounting plate(s) is(are) released, and the corresponding ventilator(s) is(are) removed or exchanged. As it is shown in FIG. 10, there is no connection between the two impellers 3, and each impeller is connected with the respective stub shaft of the respective electromotor 5 of the drive 2.

Figure 11:
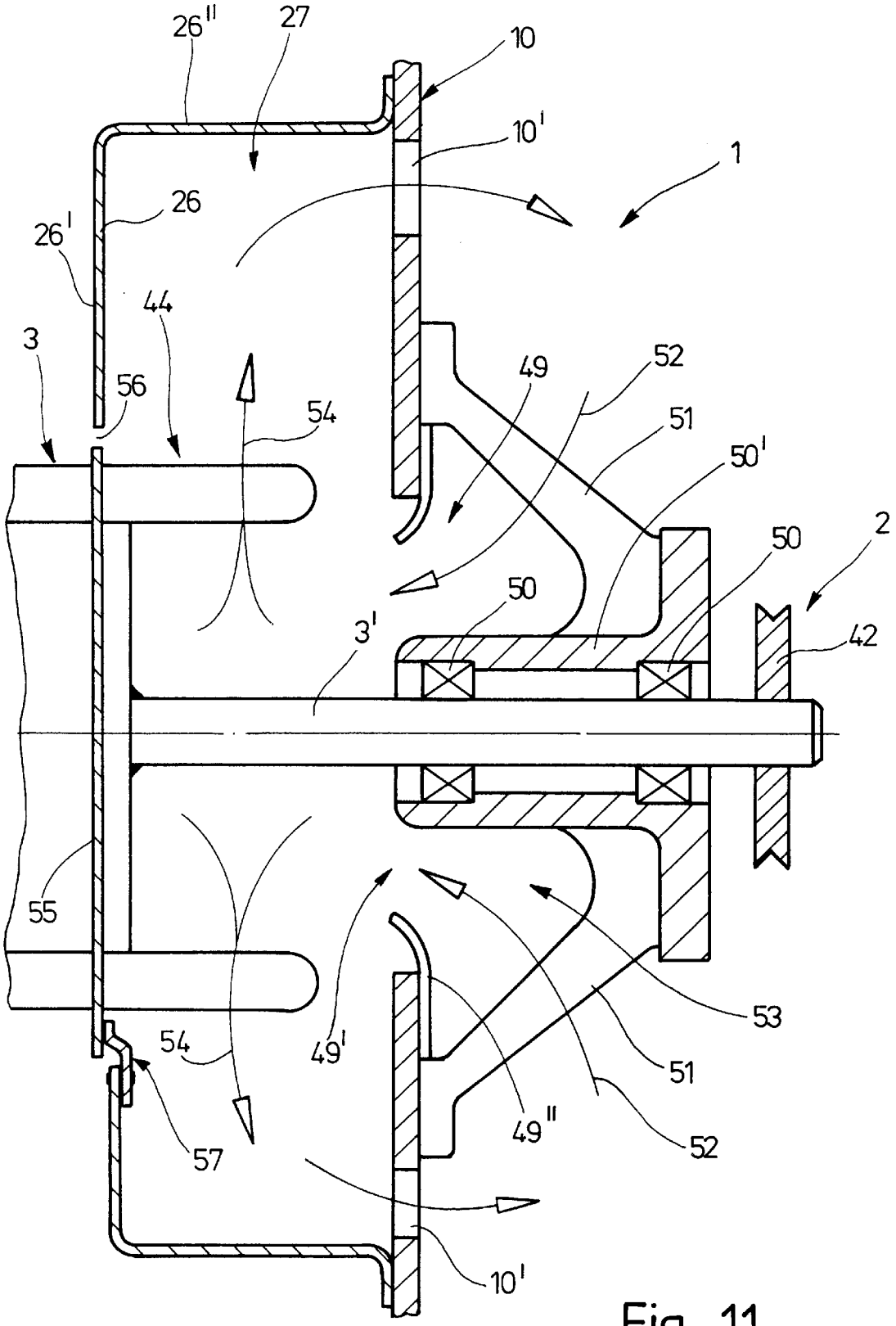
FIG. 11 is a partial cross-sectional view of a portion of cross current ventilator, according to the present invention, in the region of the impeller support.

FIG. 11 shows a detailed view of a portion of the ventilator 1 having an impeller 3, with a portion 44 of the impeller 3 projecting into an insulation zone 27. As shown in FIG. 11, the barrier wall 26 of the ventilator 1 is in contact with the mounting flange 26. The ventilator 1 has a nozzle opening 49 through which an air stream is admitted and through which the shaft $3^1$ of the impeller 3 extends.

The contour of the nozzle opening 49 is defined by a cambered portion of an annular guide sheet member $49^{11}$ provided at the outer edge of the opening $49^1$ in the mounting flange 10, into which mounting flange opening $49^1$ the cambered portion of the guide sheet member $49^1$ extends. The barrier wall 26 is formed of a radially extending portion $26^1$ and an axial portion $26^{11}$. The radial portion $26^1$ cooperates with a barrier portion 55 supported on the impeller 3 for joint rotation therewith. The axial portion $26^{11}$ of the barrier wall 26 closes the insulation zone 27.

The mounting flange 10 has, at the outer periphery of the insulation zone 27, openings $10^1$. Two spaced bearings 50, which support the shaft $3^1$ of the impeller 3, are located in a support flange $50^1$ which is attachable to the mounting plate 10 by means of webs 51. The webs 51 present only an insignificant obstruction for an air stream 52 admitted through the nozzle opening 49. The webs 52 define an air path 53 which communicates the insulation zone 27 with the atmosphere.

The atmospheric air, which serves as a cooling medium, is admitted through the nozzle opening 49 into the region of the impeller extension portion 44 and, therefrom, is displaced radially, as indicated by arrow 54, into the upper region of the insulation zone 27 from which region it flows outside through openings $10^1$ in the mounting flange 10. In this region, the ventilator 1 operates as a compressor drum whereby an optimal cooling is achieved.

In the region of the impeller extension portion 44, the rotatable barrier wall 55 and the stationary barrier wall 26 together define a gap 56 which is adequately sealed in the upper portion of the insulation zone 27. In the lower portion of the insulation zone 27, for sealing the gap, there is provided a sliding seal 57 which is attached to the barrier wall 26 and abuts the barrier wall 55, as shown in FIG. 11. To provide for engagement with the seal 57, the rotatable barrier wall 55 projects beyond the periphery of the impeller 3 a sufficient distance, as shown in FIG. 11.

At the free end of the shaft $3^1$ of the impeller 3, as shown in FIG. 11, there is located a belt pulley 42, so that the ventilator of the embodiment of FIG. 11 is driven by a belt drive.

Figure 12:
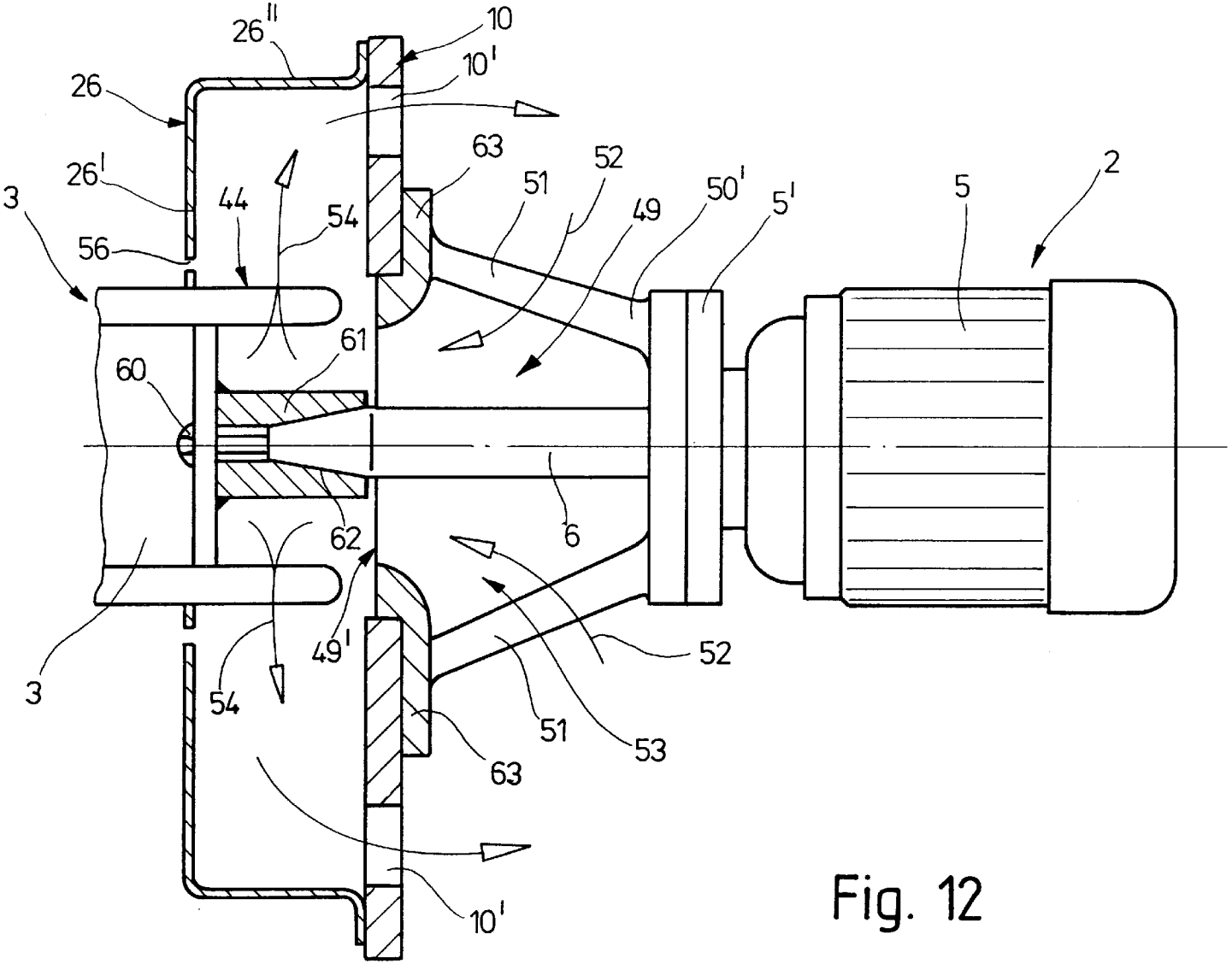
FIG. 12 is a partial cross-sectional view of a portion of another embodiment of a cross current ventilator, according to the present invention, in the region of the impeller support.

The detailed view of a portion of a cross current ventilator shown in FIG. 12 is similar to that of FIG. 11. The embodiment of FIG. 12 differs from the embodiment of FIG. 11 in that the ventilator is driven by an electromotor 5 which is connected to the support flange 50 by means of an intermediate flange $5^1$. The electromotor 5 of the embodiment of FIG. 12 has a relatively long stub shaft 6, which is connected to the impeller 3 with an axial screw connection 60.

To this end, the impeller 3 is provided, on an end wall thereof, with a bush 61 having a conical bore 62 for receiving an end portion of the stub shaft 6. The webs 51 are connected, at their free ends, to a connection element 63 which connects the support flange $50^1$ to the mounting flange 10 and defines a nozzle opening 49.

Figure 13:
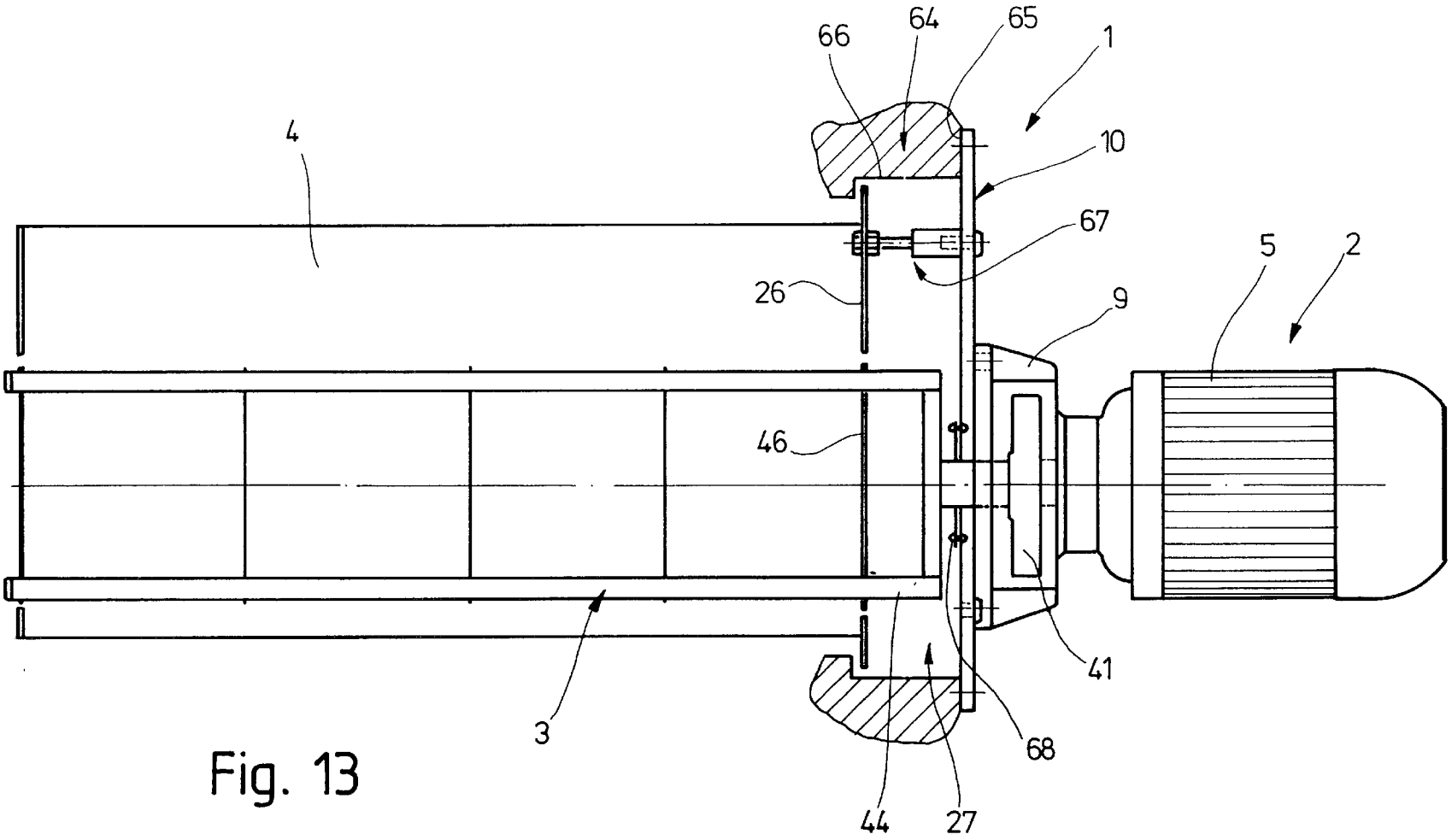
FIG. 13 is a side elevational view of yet still further embodiment of a cross current ventilator according to the present invention.

Still a further embodiment of a cross current ventilator, according to the present invention, is shown in FIG. 13. In the embodiment of FIG. 13, the electromotor 5 is provided with a flange 9 with which the electromotor 5 is connected to the mounting flange 10. The impeller 3 of the embodiment also has an extension portion 44 which projects into the insulation zone 27, which is formed between the mounting flange 10 and a barrier wall formed of a stationary barrier wall portion 26, and a closure wall 46 extending across the impeller 3 and rotatable therewith.

The air guide shrouding 4 is attached to the stationary barrier wall 26. The installation site has a flange 66, which defines an opening 64 through which the ventilator 1 extends, with the mounting flange 10 of the ventilator 1 being secured to the flange 66. The annular wall defining the flange 66 radially closes the insulation zone 27. The air guide shrouding 4 is aligned with regard to the impeller 3 by an adjusting device 67, which will be described in more detail with reference to FIGS. 15–17. A shaft seal 68, which cooperates with the shaft of the impeller 3, is secured to the mounting flange 10.

Figure 14:
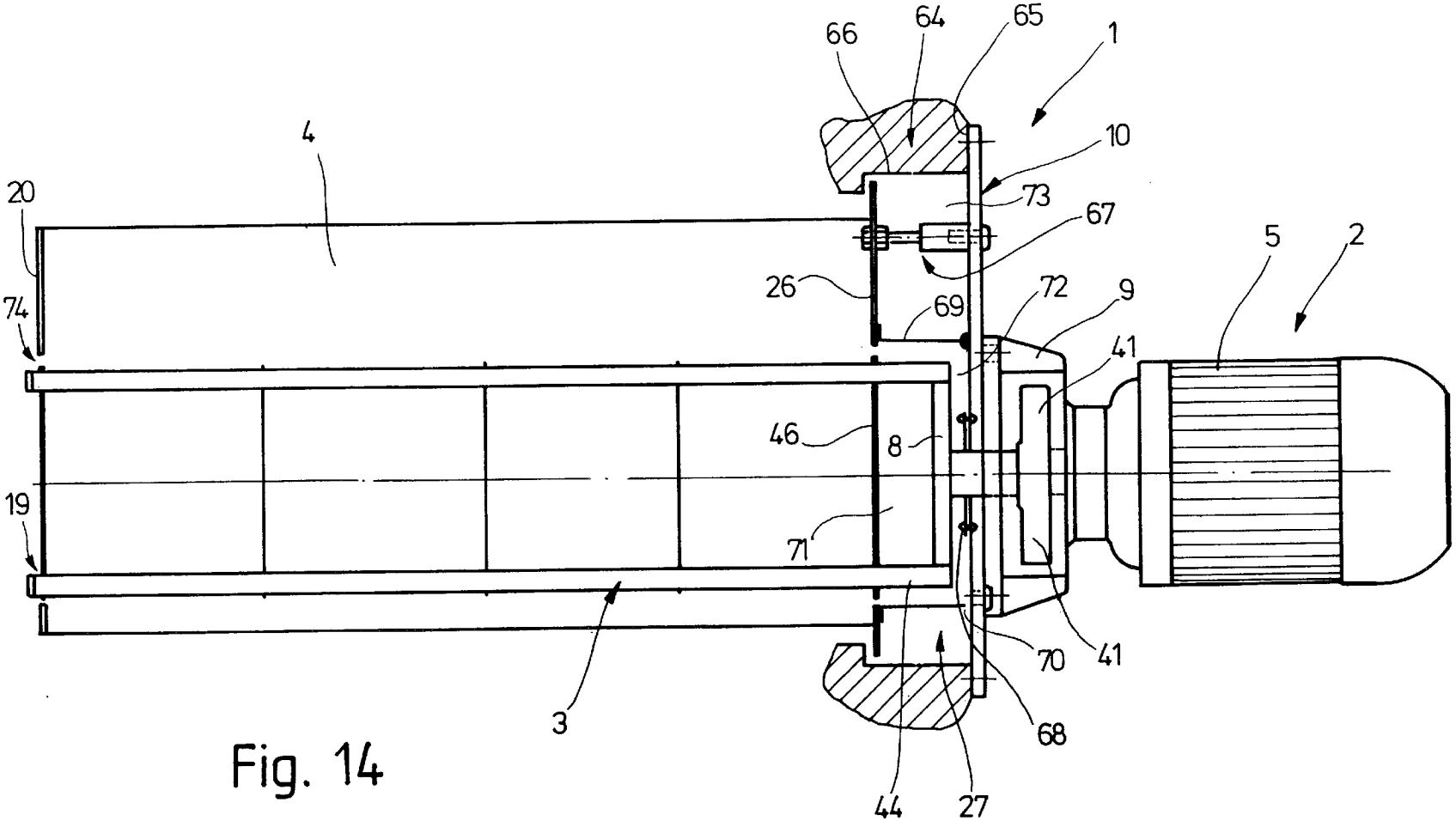
FIG. 14 is a side elevational view of still another embodiment of a cross current ventilator according to the present invention.

The embodiment of a cross current ventilator, according to the present invention, which is shown in FIG. 14, differs from the embodiment shown in FIG. 13, in that a tubular separation wall 69, which surrounds the extension portion 44 of the impeller 3, is secured between the mounting flange 10 and the barrier wall 26. The tubular wall 69 can either extend up to the mounting flange 10 (the upper portion of FIG. 14), where the tubular wall 69 can be sealed with a not heat-conducting sealing mass, or form a gap 70 with the mounting flange 10, as shown in the lower portion of FIG. 14.

The gap 70 results in only a small air exchange between the insulation zone 27 and the interior of the air guide shrouding 4. The separation tubular wall 69 defines chambers 72 and 73, with another chamber 71 being formed between the end wall 8 of the impeller 3 and a closure wall 46. The chamber 72 is defined by a space between the outer surface of the extension portion 44 of the impeller 3 and the inner surface of the tubular wall 69, and a space between the end wall 8 of the impeller 3 and the mounting flange 10.

The chamber 73 is defined by a space limited by the mounting flange 10, the barrier wall 26, the inner surface of the site flange 66, and the outer surface of the tubular wall 69. A rotatable air insulation cushion is formed in the chamber 71. As to the chambers 72 and 73, because of their closed structure, only a very small exchange of air takes place. The above-described structure of the insulation zone 27 provides for good heat insulation.

In FIG. 14, a free end portion of the impeller 3 extends through an opening 74 of the end wall 20 of the air guide shrouding 4, with a very small gap between the wall of the opening 74 and the impeller. Thereby, reliable air interception and conveyance are assured.

FIGS. 15–17, as it has been mentioned previously, show in detail the adjusting device for aligning the air guide shrouding 4 with the impeller 3. An adjusting device 67, shown in FIG. 15, comprises a plurality of adjusting element 75 which is attached to the mounting flange 10. Generally, four adjusting elements 75 are used, which together define a rectangular contour by separately adjusting each element 75, a distance between respective portions of the barrier wall 26 and the mounting flange is adjusted, whereby the clearance "X" between the impeller 3 and the air guide shrouding 4 is adjusted.

This adjustment permits to achieve a uniform width of the clearance "X" along the entire length of the impeller 3. Thus, the impeller 3 and the air guide shrouding 4 can either extend parallel to each other, or at a predetermined angle to each other, to provide for a desired direction of the air stream. The adjustment direction is shown with arrows 76.

As shown in FIG. 16, each adjusting element 75 includes a spacer 76 having a threaded bore 77. The spacer 76 has a slide end portion extending into an opening 79 in the barrier wall 26. With a threaded bolt 80 extending into the threaded bore 77 of the spacer 76, the spacer 76 can be fixedly attached to the barrier wall 26. The element 75 further includes a threaded bolt 81, which extends through the opening $\mathbf{80}^1$ in the mounting flange 10 and into the threaded bore 77 of the spacer 76. A lock nut 82 is screwed onto the threaded portion of the bolt 81. The lock nut 82 secures the position of the bolt 81 in the mounting flange 10.

When the distance a between the barrier wall 26 and the mounting flange 10 need be changed, the lock nut 82 is released, and the bolt 81 is rotated until a desired distance a is obtained. This position is secured by the lock nut 81. The adjustment of the position of the barrier wall 26 and, thereby, of the air guide shrouding 4 is effected when the bolt 80 is released, by slidably displacing the barrier wall 26 on the slide end portion 78 of the spacer 76.

As shown in FIG. 15, the adjustment of the barrier wall 26 is effected upward or downward, that is, the clearance X is varied by using respective adjusting elements 75. When a parallel arrangement between the impeller 3 and the air guide shrouding 4 is obtained with a single adjusting element 75 so that the size of the gap X is everywhere the same, the size of the gap can be then adjusted by releasing the bolts 80 and parallel displacement of the air guide shrouding 4.

Figure 18:
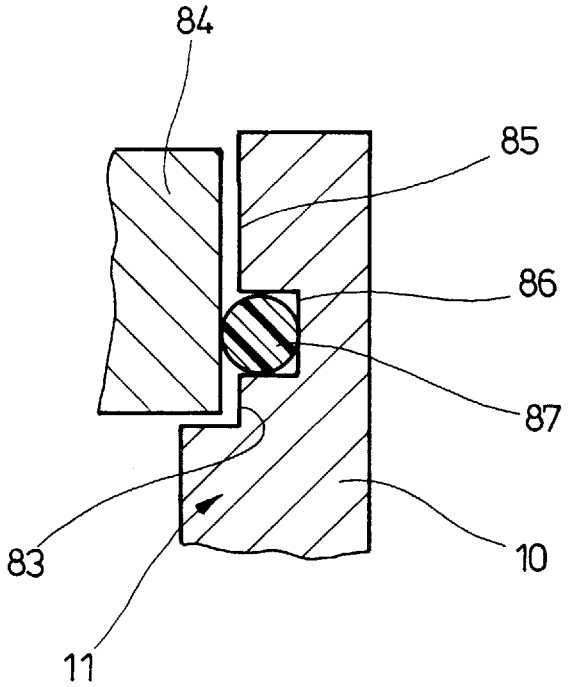
FIG. 18 is a partial cross-sectional view of a portion of the cross current ventilator, according to the present invention, in the region of mounting flanges.

FIG. 18 shows a portion of the mounting flange 10 which, preferably, is formed as a mounting plate 11. The mounting plate 11 has an annular step 83 with which the mounting plate 11 is mounted to a carrier part 84 at the installation site. The carrier part 84 engages in the step 83. The base portion 85 of the step 83 is provided with an annular groove 86 in which a resilient O-ring is located. The O-ring serves as a seal when the mounting flange 10 is secured to the carrier part 84. Thereby, the front portion of the ventilator 1 is hermetically sealed from the surrounding atmosphere.

Preferably, the impeller 3 has a large diameter-length ratio. This ratio is determined experimentally. It was found that a diameter-length ratio of 1:5 permits to achieve very good operational characteristics. With this ratio, it is possible to operate in a super-critical region with high rotational speeds. With the foregoing ratio, advantageous direct switching possibilities are available when multi-polar electromotors, such as 6,4,2-polar electro-motors, are used. When a vertical drive is used, the diameter-length ratio can be increased up to 1:8. As it has already been mentioned previously, the shaft of the impeller can be solid or hollow.

With the cross current ventilator according to the present invention, in particular when the ventilator is formed as a hot gas ventilator and the impeller has a large diameter-length ratio, the above-described air interceptor arrangement insures a high reliability at critical operational conditions.

Though the present invention was shown and described with reference to the preferred embodiments, various modifications thereof will be apparent to those skilled in the art and, therefore, it is not intended that the invention be limited to the preferred embodiment and/or details thereof and departures may be made therefrom within the spirit and scope of the appended claims.

What is claimed is:

1. A slide-in cross-current ventilator, comprising:

an impeller;

drive means for driving said impeller, said impeller being connected to said drive means in a cantilever manner so that in a mounting position of said slide-in ventilator at an installation side, said impeller is supported in an overhung position;

an air guide shrouding associated with said impeller; and a flange for mounting said slide-in ventilator as a unit at the installation site and located between said drive means and said impeller, said mounting flange being formed as a sealing flange for preventing communication between environment, in which said impeller operates, and surrounding environment in the mounting position of said slide-in ventilator at the installation site.

2. A cross current ventilator as set forth in claim 1, wherein said air guide shrouding is attached to said mounting flange in a cantilever manner.

3. A cross current ventilator as set forth in claim 1, wherein a radially extending barrier wall is located between said mounting flange and adjacent thereto an end side of said impeller, a space between said mounting flange and said barrier wall defining an insulation zone.

4. A cross current ventilator as set forth in claim 3, further comprising a plurality of axially spaced additional barrier walls arranged in said insulation zone between said mounting flange and said barrier wall.

5. A cross current ventilator as set forth in claim 4, wherein said barrier wall and said additional barrier walls are attached to at least one of said mounting flange and said air guide shrouding.

6. A cross current ventilator as set forth in claim 4, wherein said plurality of additional barrier walls comprises barrier walls mounted on at least one of a shaft of said drive means and a shaft of said impeller for joint rotation therewith.

7. A cross current ventilator as set forth in claim 5, wherein said additional barrier walls comprise stationary barrier walls, and barrier walls mounted on at least one of a shaft of said drive means and a shaft of said impeller for joint rotation therewith.

8. A cross current ventilator as set forth in claim 7, wherein said barrier wall is stationary, and wherein said stationary barrier wall and said additionally stationary barrier walls and said rotatable additional barrier walls form labyrinth sealing means.

9. A cross current ventilator as set forth in claim 3, wherein said impeller has an extension portion projecting through said barrier wall into said insulation zone and extending up to said mounting flange.

10. A cross current ventilator as set forth in claim 9, further comprising nozzle opening means for admitting environmental air into said insulation zone and inside said extension portion, and opening means through which air, which flows from the inside of said extension portion radially, flows back into the atmosphere.

11. A cross current ventilator as set forth in claim 1, wherein said impeller has a shaft projecting from an end wall of said impeller, which is adjacent to said mounting flange.

12. A cross current ventilator as set forth in claim 1, wherein said impeller has a shaft extending along an entire length of said impeller.

13. A cross current ventilator as set forth in claim 1, wherein a diameter-length ratio of said impeller is up to 1:10.

14. A cross current ventilator as set forth in claim 1, wherein the diameter-to-length ratio of said impeller is 1:5.

* * * * *